United States Patent [19]

Abe et al.

[11] Patent Number: 4,578,979

[45] Date of Patent: Apr. 1, 1986

[54] METHOD OF PRODUCING A STRIP HAVING A NON-UNIFORM CROSS SECTION BY A ROLLING PROCESS

[75] Inventors: Hajime Abe; Noboru Hagiwara; Kazuo Ishida; Tadao Otani; Osamu Kawamata; Manabu Kagawa, all of Ibaraki, Japan

[73] Assignee: Hitachi Cables, Ltd., Tokyo, Japan

[21] Appl. No.: 526,589

[22] Filed: Aug. 26, 1983

[30] Foreign Application Priority Data

Oct. 27, 1982 [JP] Japan ..... 57-188828

[51] Int. Cl.[4] ..... B21B 1/12

[52] U.S. Cl. ..... 72/199; 72/177; 72/234; 72/366

[58] Field of Search ..... 72/199, 234, 226, 177, 72/365, 366

[56] References Cited

U.S. PATENT DOCUMENTS

| | | | |
|---|---|---|---|
| 2,193,737 | 3/1940 | Penkala | 72/366 X |
| 4,279,139 | 7/1981 | Schmitz | 72/234 |
| 4,295,354 | 10/1981 | Itoh et al. | 72/366 X |
| 4,402,206 | 9/1983 | Yanazawa et al. | 72/366 X |
| 4,433,565 | 2/1984 | Preller | 72/177 |

*Primary Examiner*—Francis S. Husar
*Assistant Examiner*—Steven B. Katz
*Attorney, Agent, or Firm*—Sughrue, Mion, Zinn, Macpeak and Seas

[57] ABSTRACT

A method for producing a strip of material having a non-uniform cross section is carried out by passing a strip of material in the longitudinal direction through a first set of working rolls, at least one of which is provided with an annular slot intermediate the ends thereof so that a reducing force is applied only to those portions of the strip engaging said roll on opposite sides of the slot whereby the excess material flows toward that portion of the strip opposed to the slot to cause the strip to buckle outwardly into the slot. The strip is subsequently passed through a set of smooth rolls to flatten the buckled portion. This procedure is repeated any desired number of times with the width of the slot becoming progressively smaller. The strip may then be passed through one or more sets of finishing rolls and a heating and annealing operation can take place before each passage through a set of finishing rolls.

6 Claims, 9 Drawing Figures

METHOD OF PRODUCING A STRIP HAVING A NON-UNIFORM CROSS SECTION BY A ROLLING PROCESS

BACKGROUND OF THE INVENTION

The present invention is directed to a method of producing a strip of material having longitudinally continous portions, the thickness of which varies in the direction of width of the strip, that is, a strip having a non-uniform cross section, by a rolling process.

It is well known that if a blank of uniform thickness is rolled with a partially changed reduction rate to provide a strip having a non-uniform cross section, the amount of deformation of the material is locally different and the difference in the amount of deformation results in a difference in longitudinal expansion of the rolled strip, thereby causing the occurrance of meandering or twisting in the rolled strip.

In order to solve the problem of meandering or twisting, a lateral rolling method was employed to cause the deformed material to flow in the direction of width of the blank or an expanding rolling method was employed. In the lateral rolling method, however, the blank is rolled in a direction perpendicular to the longitudinal direction of the blank and therefore it is necessary to intermittently feed the blank material. This results in a deterioration of the working properties of the material and considerably reduces the production rate. In the expanding rolling method, on the other hand, in which the thickness of the material is changed in the direction of width by a reduction process using a combination of the V-shaped die and a roll, the reduction force is produced by causing the roll to perform a reciprocating motion. Therefore, the processing of the strips must take place intermittently and it is impossible to achieve a high speed, efficient rate of production.

SUMMARY OF THE INVENTION

The present invention provides a new and improved method for producing a strip having a non-uniform cross section by a rolling process wherein meandering and twisting are prevented from occurring and wherein remarkable working properties are achieved as well as a high rate of production.

The present invention provides a new and improved method for producing a strip having a non-uniform cross section by a rolling process wherein the reduction force is applied in the longitudinal direction of the strip by a roll having an annular groove or slot located between two annular work contacting surfaces so that the reduction force is only applied to those portions of the blank which are to be reduced thereby allowing the portion of the blank adjacent the slot to buckle outwardly as a result of the flow of material due to the deformation of the portions being reduced in thickness. By having the flow of deformed material absorbed in the central portion of the strip which buckles outwardly into the slot or groove, meandering or twisting of the strip due to variations in the amount of deformation can be prevented from occurring.

The present invention provides a new and improved method for producing a strip having a non-uniform cross section by a rolling process wherein the outwardly buckled deformed central portion of the strip obtained by rolling with the slotted roller is subsequently rolled by a roll having a uniform diameter to a predetermined thickness. The present invention further contemplates the step of heating the strip to anneal the same, thereby adjusting the hardness of the strip.

The present invention provides a new and improved method of producing a strip having a non-uniform cross section by a rolling process which can be applied to a strip of ordinary non-ferrous material, such as copper, copper alloy, aluminum and aluminum alloy, various iron/steel materials and any combination of these materials, to provide a strip suitably adjusted in shape and/or hardness.

The foregoing and other objects, features and advantages of the present invention will be apparent from the following more particular description of a preferred embodiment of the invention as illustrated in the accompanying drawings.

DETAILED DESCRIPTION OF PREFERRED EMBODIMENTS

Figure 1:
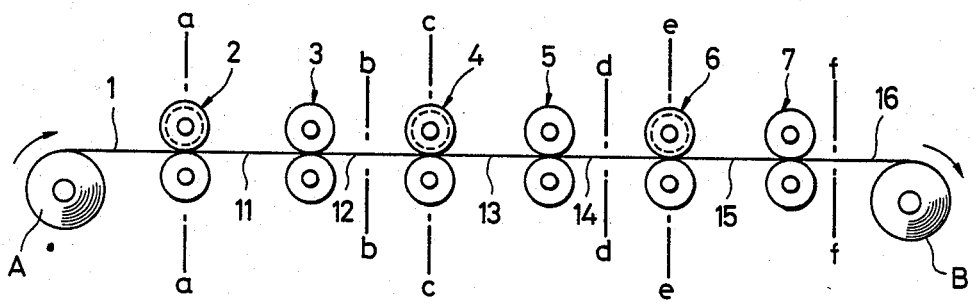
FIG. 1 is a schematic view of a production line illustrating an embodiment of the method according to the present invention.
Figure 2:
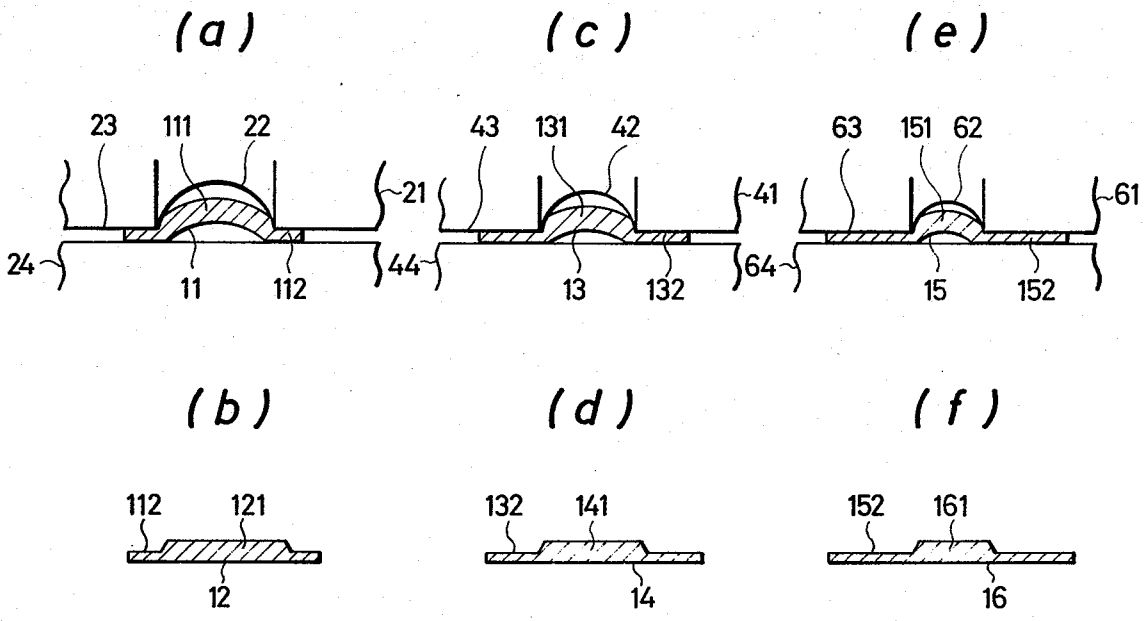
FIGS. 2(*a*)–2(*f*) are enlarged cross sectional views of the strip as viewed along the respective section lines in FIG. 1.

FIG. 1 is a schematic view illustrating a production line for continuously obtaining a strip 16 having a non-uniform cross section having two relatively thin longitudinal edge portions on opposite sides of a relatively thick longitudinal central portion such as shown in FIG. 2(*f*). In this embodiment, a blank 1 is supplied from a feed roll A and is passed through three pairs of rolls 2, 4, and 6, wherein one roll of each pair is provided with an annular groove or slot and three additional pairs of rolls 3, 5, and 7, which are located immediately downstream of the rolls 2, 4, and 6, respectively. The rolls in each of the pairs of rolls 3, 5, and 7, are of uniform diameter, thereby providing a smooth cylindrical surface. The center of the blank is aligned with the center of the groove or slot in the roll set and is subsequently taken up by the take-up roll B. All of the roll pairs may be intermittently actuated or, alternatively, any roll pair or pairs among the intermittently actuated roll pairs may be continuously actuated. The number of roll sets, both slotted and smooth, is selected in accordance with the quality of the material, the thickness and lateral dimensions of the blank and the desired cross sectional thickness ratio of the end product. Accordingly, in some cases only a single rolling operation by a slotted roller and a single rolling operation by a smooth roll pair are necessary, whereas in other cases, additional rolling operations are required. In performing the operations according to the present invention on a production line such as that shown in FIG. 1, it is conceivable that the blank will pass through additional guide rolls which will not perform any deformation function.

The three roll pairs 2, 4, and 6, are constituted respectively by a combination of a smooth roll 24 and a roll 21 having an annular slot of predetermined width and depth formed therein as shown in FIG. 2(*a*), a combination of a smooth roll 44 and a roll 41 having an annular slot 42 of predetermined width and depth formed therein as shown in FIG. 2(*c*), and a combination of a smooth roll 64 and a roll 61 having an annular slot 62 of predetermined width and depth formed therein as shown in FIG. 2(*e*). The respective widths of the slots 22, 42, and 62, are progressively narrower in the order named and the depth of each slot is selected to define a space large enough to accomodate the buckled deformed portion of the material. Therefore, the cross sectional shape of each slot is not limited to the semi-circular configuration as shown in the drawings, but may be rectangular, trapezoidal, triangular, etc. The boundary between the slot and each of the smooth annular portions bordering the slot, does not necessarily have to be sharp as illustrated in the drawings, but may be beveled or rounded as necessary.

Referring once again to FIG. 1, a blank having a predetermined width and thickness is first passed through the roll pair 2. In this rolling operation, a reduction force is applied to the blank 1 only along the opposite parallel side portions of the strip engaged by the smooth cylindrical portions 23 located on opposite sides of the slot 22 as best seen in FIG. 2(*a*). Upon the application of the reduction force at this point most of the material from the portions of the strip being reduced will flow in the direction having the least resistance, that is, toward the central slot 22, thereby causing the central portion of the strip to buckle upwardly into the slot 22. Thus, the blank form is shaped to define a strip 11 having a buckled, thick central portion 111 and reduced thickness portions 112 on opposite sides thereof, as shown in FIG. 2(*a*). Thereafter, the strip 11 is passed through the roll pair 3 comprised of a pair of smooth rollers, whereby the portion 111 is rolled flat to define the strip 12 as shown in FIG. 2(*b*). In this case, the thick, central portion 121 is not necessarily completely flat, but may be partially flat or curved. However, it is desirable that the thick portion 121 be substantially flat. This is also true with respect to the roll pairs 5 and 7 which roll the thick central portions 141 and 161 of the strips 14 and 16 as shown in FIG. 2(*d*) and FIG. 2(*f*), respectively. Alternatively, the amount of reduction at these stages may be increased so as to produce a little expansion in the direction of rolling. The provision of a small amount of expansion in the direction of rolling eliminates any waves or wrinkles which might have occured in the preceeding process.

A copper strip having a thickness 2 mm and a width of 60 mm was rolled using a roll pair comprised of a smooth roll and a slotted roll having a cross section of semi-circular shape having a radius of 12.5 mm with the center of the strip aligned with the slotted portion of the roll so as to reduce the thickness of each of the thin portions on opposite sides to 0.8 mm and was thereafter rolled again by a pair of smooth rollers so as to flatten the deformed central portion of the strip. The resulting strip was straight and no waves or wrinkles could be observed in the thin portions at the opposite sides of the central portion.

The strip 12 was then passed through the roll pair 4 to be processed in the same manner as in roll pair 2 to thereby obtain the strip 13. That is, the strip 12 was pressed on opposite sides of the thick central portion 121 by the parallel smooth portion 43 located on opposite sides of the slot 42 in the roll 41 so as to increase the width of each of the thin portions 132 so that the non-reduced central portion in the slot 42 is buckled upwardly or deformed into the slot 42 as shown in FIG. 2(*c*). The strip 13 was then passed through the roll pair 5 to flatten the buckled central portion 131 to obtain the strip 14 which was then passed through the roll pair 6. At the roll pair 6 the strip 14 was once again pressed along the edge portions thereof on opposite sides of the thick portion 141 by the smooth portions 63 of the roll 66 so that the width of each of the thick edge portions 152 is widened to obtain the strip 15 having the buckled upwardly deformed portion 151 as shown in FIG. 2(*e*). The strip 15 was then passed through the roll pair 7 to flatten the central deformed portion 151 to obtain the strip 16 having the predetermined thin portions 152 on opposite sides of the thick portion 161 as shown in FIG. 2(*f*). In cases where the deformation of the portion 151 is relatively small, the rolling step by the roll pair 7 may be omitted.

According to a second example, a copper strip having a thickness of 3.4 mm and a width of 52 mm was rolled using a slotted roll having a cross section of semi-circular configuration with a radius of 20 mm so as to obtain a strip having thin edge portions each of which has a thickness of 0.9 mm and a width of 10 mm. After rolling the strip by a pair of flat rolls, the strip was then passed through another slotted roll pair having a cross section of semi-circular configuration with a 16.5 mm radius so as to widen the width of each of the thin portions to 17 mm. The strip was then passed through another pair of smooth rolls and then rolled by a further slotted roll having a semi-circular cross sectional configuration with a 14 mm radius so as to further widen the width of each of the the thin portions to 22 mm. The strip was finally rolled by a further pair of smooth rollers to obtain a strip which was straight with the thin portions on opposite sides being flat without any waves or wrinkles.

Figure 3:
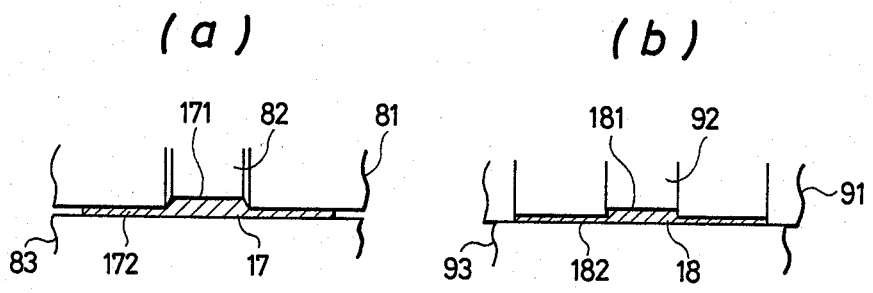
FIGS. 3(*a*) and 3(*b*) are cross sectional views showing rolling steps subsequent to the rolling steps illustrated in FIG. 1.

In those cases where it is necessary to further shape the strip 16, the strip may be successively finish rolled with a substantially uniform reduction rate in accordance with the desired cross sectional thickness ratio of the strip by using rolls 81 and 91 having slots 82 and 92, respectively, as shown in FIGS. 3(*a*) and 3(*b*). For the purpose of carrying out the finish rolling operation, any one of the two rolls 81 and 91 may be used. The number of rolls through which the strip is passed is properly selected in accordance with the cross sectional thickness ratio of the portions of the strip.

Prior to passing the strips 16 through the pair of rolls 81 and 83, the strip may be subjected to a heating/annealing process. The rolls 81 and 83 expand the strip 16 substantially uniformly in the longitudinal or rolling direction so as to define the strip 17 having a cross section as shown in FIG. 3(*a*) which is approximate to the strip 18. The strip 17 is subjected to a further heating/annealing process and then passed through a pair of rolls 91, 93 to define a finished strip having a predetermined dimension and shape. In the finishing rolling operation, if the difference in reduction ratio between the thick portions 171, 181 and the thin portions 172, 182, exceeds ten percent, a wave or wrinkle may occur in the portion at which the reduction rate is larger and therefore the difference in the reduction rate should be selected to be within ten percent, preferably within five percent.

The strip obtained in the first mentioned embodiment was annealed at 450° C. for thirty minutes and then rolled with a substantially uniform reduction rate at the respective portions thereof so as to obtain a finished strip having a thick portion of 1.0 mm thickness and thin portions each having a thickness of 0.4 mm. As another example, the strip obtained in the second mentioned embodiment was annealed at 450° C. for thirty minutes and then rolled with a reduction rate of about thirty-five percent at respective portions thereof so as to make the thickness of the thick portion 2.0 mm and the thickness of the thin portions 0.6 mm. The thus obtained strip was further annealed at 450° C. for thirty minutes and then rolled to reduce the thickness of the thick portion to 1.26 mm and the thin portions to 0.38 mm. No waves or wrinkles could be observed in the thin portions of the strip, and no twisting was observed along the length of the strip.

The annealing process is suitable for adjusting the hardness or the uniform workability of the strip. Accordingly, the annealing step is suitably added to the rolling steps either ahead or behind the specific rolling step. In the case where such intermediate processing is not required, the process can be continuously performed by a single production line through the finishing rolling step, thereby improving the production rate.

In the examples mentioned above, the longitudinally extending thick portion is formed on only one side of the strip. It is, of course, possible to vary the construction of the slotted roll pair such that the number of thick portions can be increased by properly selecting the number and location of the slots formed in the roll. Likewise, thick portions may be formed on opposite sides of the strip using a pair of rolls, each of which is provided with one or more slots. Alternatively, each strip may be slit cut to form various types of strips having any desired non-uniform cross section. It is, of course, possible to obtain a plurality of strips at the same time by processing a blank having a thickness several times as thick as the desired thickness and cutting the processed strip in the desired manner.

As mentioned previously, according to the present invention, a slotted roll is used to roll a strip such that only those portions which must be made thinner are reduced by the roll without substantially reducing the thick portion so that the principal portion of the material flowing from the reduced portion flows to the vicinity of the slot whereby it may be accomodated therein. Thus, very little expansion is produced in the longitudinal or rolling direction of the strip so that it is possible to run the strip continuously for producing a deformed strip without any meandering or twisting occurring. Also, the number of working steps may be decreased and the production rates substantially improved. Further, the slotted roll can be provided by the combination of a first hollow cylindrical roll having a predetermined axial length and small outer diameter, and second hollow cylindrical rolls having outer diameter larger than that of the first roll.

While the invention has particularly shown and described with reference to a preferred embodiment thereof, it will be understood by those in the art that the foregoing and other changes in form and details may be made therein without departing from the spirit and scope of the invention.

What is claimed is:

1. A method for shaping a substantially continuous strip of material having a substantially uniform cross section into a substantially continuous strip having a non-uniform cross section defined by at least one thick section and two thin sections on opposite sides of said thick section, comprising the steps of:

passing said continuous strip having a substantially uniform cross section in the longitudinal direction through a first pair of reduction rolls, at least one of which has an annular slot intermediate the ends thereof, to provide a reducing force to reduce the thickness of only those portions of said strip engaging said roll on opposite sides of said slot, said passing step including the provision of sufficient reducing force on said engaging portions of said strip to cause the unengaged portion of said strip to form a buckled portion in said slot, and passing the strip coming through said first pair of rolls through a second pair of reduction rolls, each having a smooth cylindrical surface, to roll said buckled portion to a predetermined thickness, thicker than the remaining portions of said strip.

2. A method according to claim 1 further comprising passing the strip exiting from said second pair of rolls through successive additional pairs of working rolls, with pairs having at least one roll with an annular slot being arranged alternately with pairs having smooth rolls, the respective slots of all rolls having said annular slots being progressively smaller in the processing direction of said shaping method.

3. A method according to claim 1 further comprising rolling said strip with a substantially uniform reduction rate in accordance with the thickness ratio in the direction of width of said strip.

4. A method according to claim 3 wherein said rolling of said strip is carried out by means of at least one set of finishing rolls one of which has a variable diameter across the width thereof adapted to contact the strip across its entire width.

5. A method according to claim 4 further comprising heating and annealing said strip before passing said strip through said finishing rolls.

6. A method according to claim 5 wherein a plurality of said finishing rolls are provided and further comprising heating and annealing said strip prior to each passage of said strip through a finishing roll set.

* * * * *